US007121319B2

(12) United States Patent
Murray et al.

(10) Patent No.: US 7,121,319 B2
(45) Date of Patent: Oct. 17, 2006

(54) MAGNESIUM PRESSURE CASTING

(75) Inventors: Morris Taylor Murray, Briar Hill (AU); Matthew Alan Cope, Somerville (AU)

(73) Assignee: Commonwealth Scientific and Industrial Research Organisation, Campbell (AU)

( * ) Notice: Subject to any disclaimer, the term of this patent is extended or adjusted under 35 U.S.C. 154(b) by 0 days.

(21) Appl. No.: 10/663,437

(22) Filed: Sep. 16, 2003

(65) Prior Publication Data

US 2005/0072548 A1 Apr. 7, 2005

Related U.S. Application Data

(62) Division of application No. 09/554,507, filed as application No. PCT/AU98/00987 on Nov. 30, 1998, now Pat. No. 6,634,412.

(30) Foreign Application Priority Data

Nov. 28, 1997 (AU) ..... PP0604

(51) Int. Cl.
*B22D 17/00* (2006.01)

(52) U.S. Cl. ..... 164/113; 164/312; 164/900

(58) Field of Classification Search ..... 164/113, 164/900, 312

See application file for complete search history.

(56) References Cited

U.S. PATENT DOCUMENTS

| | | | | |
|---|---|---|---|---|
| 4,473,103 | A | 9/1984 | Kenney et al. | |
| 4,565,241 | A | 1/1986 | Young | |
| 4,687,042 | A | 8/1987 | Young | |
| 4,986,338 | A | 1/1991 | Yamauchi et al. | 164/457 |
| 5,040,589 | A * | 8/1991 | Bradley et al. | 164/113 |
| 5,076,344 | A | 12/1991 | Fields et al. | 339/72.5 |
| 5,211,216 | A | 5/1993 | Drury et al. | 164/120 |
| 5,263,531 | A | 11/1993 | Drury et al. | 164/120 |
| 5,361,826 | A | 11/1994 | Yamauchi et al. | 164/457 |
| 5,394,931 | A | 3/1995 | Shiina et al. | 164/113 |

(Continued)

FOREIGN PATENT DOCUMENTS

DE 4312175 10/1994

(Continued)

OTHER PUBLICATIONS

ASM Handbook, vol. 15 Casting, The Materials Information Society, USA, 1988. pp. 286-295, 327-338.

(Continued)

*Primary Examiner*—Len Tran
(74) *Attorney, Agent, or Firm*—Ladas & Parry LLP

(57) ABSTRACT

The provision or use, for the pressure casting of magnesium alloy in a molten or thixotropic state with a pressure casting machine having a mould or die which defines a die cavity, of a metal flow system which includes a die or mould tool means which defines at least one runner from which molten magnesium alloy is able to be injected into the die cavity. The metal flow system is of a form providing for control of metal flow velocities within the flow system, whereby substantially all of the metal flowing throughout the die cavity is in a viscous or semi-solid state. Filling of the die cavity is able to proceed progressively by semi-solid fronts of metal moving away from a gate or other site of injection. The flow of magnesium alloy from the runner may be via at least one controlled expansion region of the metal flow system in which region the metal flow is able to spread laterally, with respect to its direction of injection, with a resultant reduction in its flow velocity relative to its velocity in the runner.

30 Claims, 7 Drawing Sheets

U.S. PATENT DOCUMENTS

| | | | | |
|---|---|---|---|---|
| 5,685,357 | A * | 11/1997 | Kato et al. | 164/113 |
| 5,697,422 | A | 12/1997 | Righi et al. | 164/120 |
| 5,787,959 | A * | 8/1998 | Laxmanan et al. | 164/66.1 |

FOREIGN PATENT DOCUMENTS

| | | |
|---|---|---|
| EP | 701002 | 3/1996 |
| EP | 799901 | 10/1997 |
| EP | 0968782 | 1/2000 |
| JP | 58-125356 | 7/1983 |
| JP | 59-97749 | 6/1984 |
| JP | 9-253821 | 9/1997 |
| WO | 9706907 | 2/1997 |
| WO | 9730806 | 8/1997 |

OTHER PUBLICATIONS

Cope, M. A., et al. *User Manual Metlflow,vol. 1: Design Concept*, Colin Austin R&D Pty. Ltd., Melbourne, Australia, Apr. 1985. pp. i, ii, 2.1-2.2.

Cope, M. A., et al. *User Manual Metlflow, vol. 2*, Colin Austin R&D Pty. Ltd., Melbourne, Australia, Apr. 1985. pp. 3.6-3.8, 5.1-5.4 & "Flow Anlaysis Guide."

Cope, M. A., et al. *Zinc pressure die-casting—the metal flow system*, Australian Zinc Development Corporation, Mar. 1979, pages title, 2-5, 26, 46.

Modigell, M., et al., "Time-Dependent Rheological Properties of Semi-Solid Metal Alloys", *Mechanics of Time-Dependent Materials*, 3: 15-30, 1999.

* cited by examiner

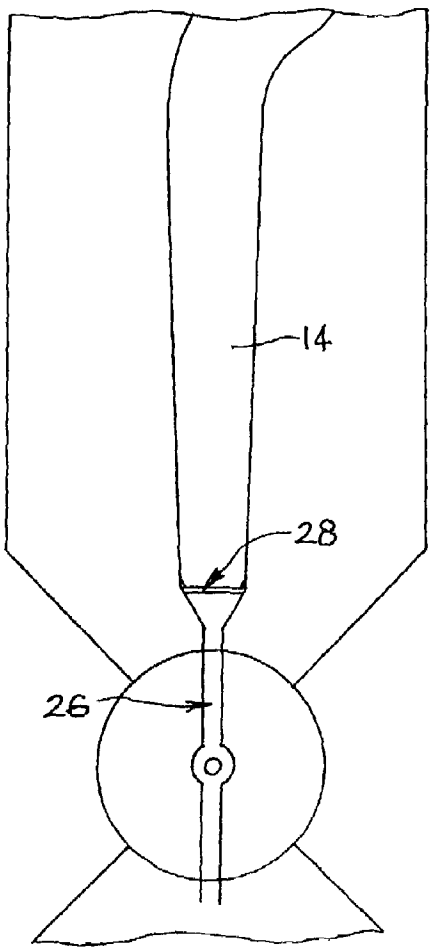
FIG 2
FIG 1
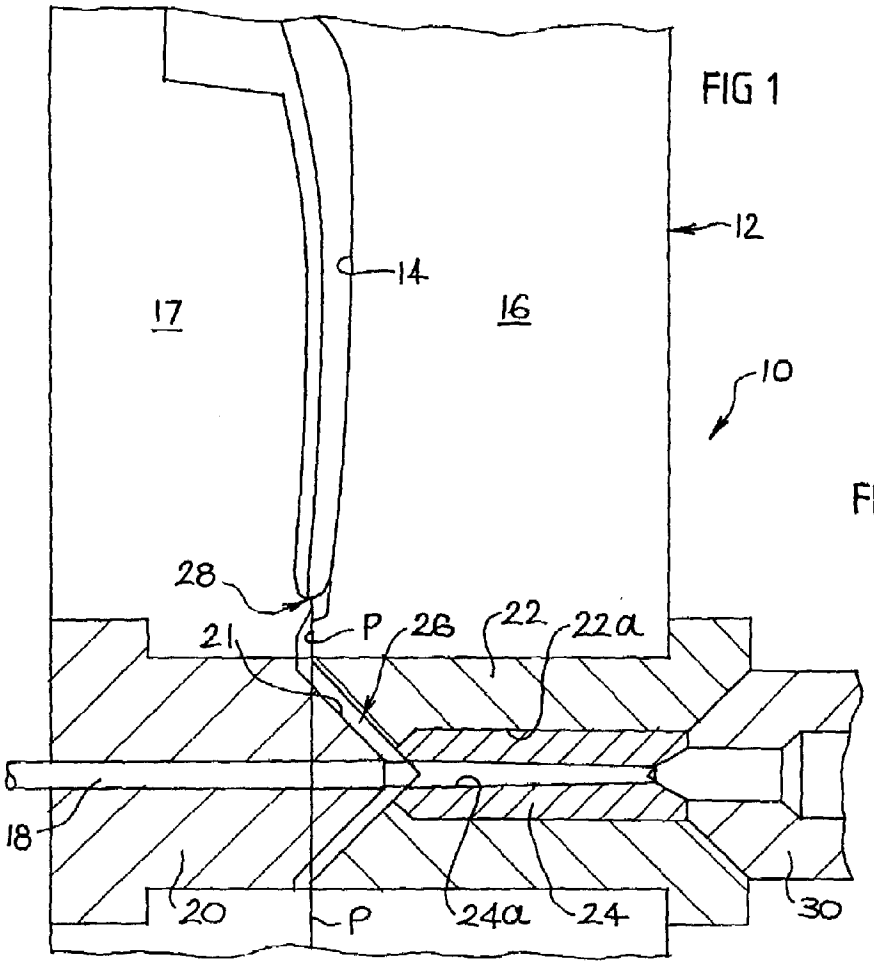

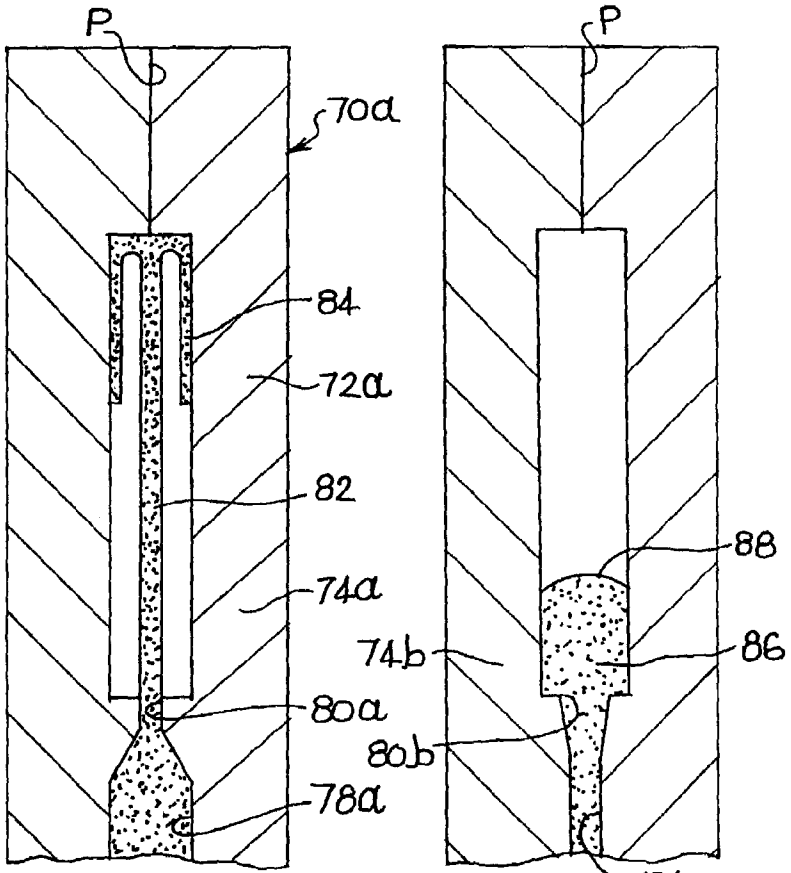
FIG 8A
FIG 8B
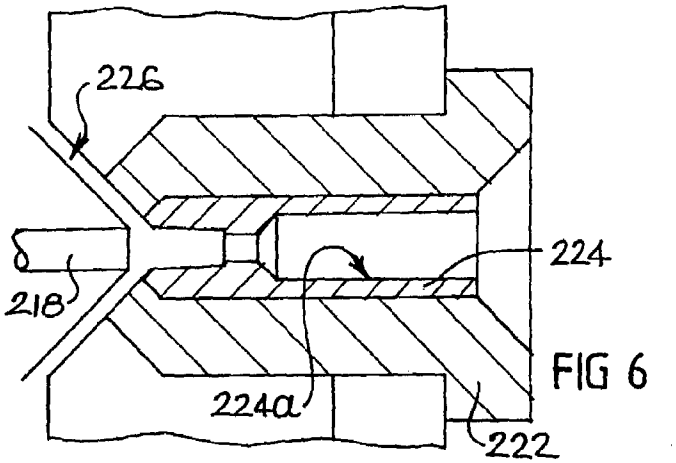
FIG 6
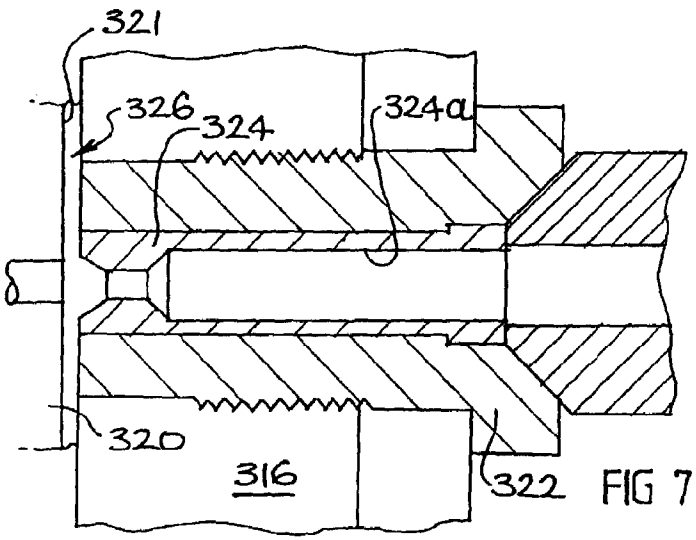
FIG 7

MAGNESIUM PRESSURE CASTING

This application is a divisional of application Ser. No. 09/554,507 filed on Jun. 28, 2000 now U.S. Pat. No. 6,634,412, which is International Application PCT/AU98/00987 filed on Nov. 30, 1998, which designated the U.S., claims the benefit thereof and incorporates the same by reference.

This invention relates to an improved metal flow system, for use in the production of pressure castings made from magnesium alloys in a molten or thixotropic state and suitable for use with existing machines in various forms including hot and cold chamber die casting machines.

An understanding has developed throughout the international pressure casting industry that, because of the lower heat capacity of magnesium alloys compared to zinc and aluminium alloys, it is necessary to use large runners and gates to prevent premature freezing of the molten magnesium alloy metal. Indeed, this is considered best practice by the industry, although interpretations vary considerably.

Within the industry, there are many different design methods which are thought to provide satisfactory castings from magnesium alloys. However, the magnesium alloy pressure castings produced by these methods generally exhibit a greater degree of surface defects, when compared to zinc or aluminium pressure castings, although castings may be of servicable quality.

We have found that it is possible to produce high quality pressure castings of magnesium alloys with use of the present invention. The castings so produced are able to be of a quality comparable to that obtainable with castings of aluminium or zinc alloys. Moreover, we have found that casting quality is able to be enhanced by the use of metal flow systems having runners and gates which are small relative to current best practice. The metal flow systems of the invention enable a substantial improvement in the casting yield; that is, in the percentage ratio of casting weight to total shot weights. Thus, the weight of metal which needs to be recycled and reprocessed is able to be substantially reduced, with resultant reduction in production costs.

The present invention enables a method of calculating metal flow systems for the production of magnesium alloy castings which exhibit improved quality and with significantly less metal in the feeding systems, with consequent reduction in cost compared to prior practices.

The present invention provides or uses, for the pressure casting of magnesium alloy in a molten or thixotropic state with a pressure casting machine having a mould or die which defines a die cavity, a metal flow system which includes a die or mould tool means which defines at least one runner from which molten magnesium alloy is able to be injected into the die cavity. In a first form of the invention, the metal flow system is of a form providing for control of metal flow velocities within the flow system, whereby substantially all of the metal flowing throughout the die cavity is in a viscous or semi-solid state.

The invention also provides a process for producing a casting of a magnesium alloy, wherein the magnesium alloy is cast in a molten or thixotropic state, using a pressure casting machine having a mould or die which defines a die cavity, and using a metal flow system which includes a die or mould tool means which defines at least one runner of the system from which molten magnesium alloy is injected into the die cavity, and wherein the flow system is of a form whereby it provides for control of metal flow velocities therein whereby substantially all of the metal flowing throughout the die cavity is in a viscous or semi-solid state.

Our findings indicate that, with the attainment of a viscous or semi-solid state, filling of the die cavity proceeds progressively by semi-solid fronts of metal moving away from a gate or other site of injection. This form of filling with magnesium alloy is a major departure from the highly complex liquid peripheral fill, followed by back-filling, encountered with die casting of aluminium or zinc alloys and first described by Frommer in 1932 (see the reference text "Die Casting" by H. H. Doehler, published 1991 by McGraw-Hill Publishing, Inc.

In the first form of the invention, the flow of magnesium alloy from the runner is via at least one controlled expansion region of the metal flow system in which region the metal flow is able to spread laterally, with respect to its direction of injection, with a resultant reduction in its flow velocity relative to its velocity in the runner. In a preferred arrangement, the controlled expansion region of the flow system comprises a gate through which the metal flows from the runner to the die cavity. In that preferred arrangement, the gate and runner are such that an effective cross-sectional area of flow through the gate exceeds an effective cross-sectional area of flow through the runner, whereby the molten metal has a velocity through the effective cross-sectional area of flow through the runner which exceeds its velocity through the gate. This is contrary to current recommended practice.

In that preferred arrangement according to the first form of the invention, the cross-sectional area of flow through the gate preferably exceeds the effective cross-sectional area of flow through the runner to an extent providing for a ratio of those areas in the range of about 2:1 to 4:1.

The effective cross-sectional area of flow through the runner may prevail throughout the full longitudinal extent of the runner. However, the effective area may prevail over only part of that longitudinal extent. Thus, in the latter case, there may be a larger cross-sectional area of flow through the runner up-stream from the part of its longitudinal extent in which the effective cross-sectional area of flow prevails.

In an alternative arrangement according to the first form of the invention, the controlled expansion region is defined at least in part by and within the cavity, by surfaces defining the cavity adjacent to the site at which the metal enters the cavity. In this alternative arrangement, there may be an in gate at that site, through which metal flows from the runner to the cavity. In that case, the gate need not define a controlled expansion region due to it having a larger effective cross-section than the runner, and the gate may simply comprise the outlet end of the runner at the cavity. However, the gate may define part of a controlled expansion region of which a further part is defined by and within the die cavity.

The alternative arrangement, in which the metal flow system has a controlled expansion region, defined at least by and within the die cavity, is not suitable for all die cavity shapes. Also, attainment of such region is dependent upon the flow direction as the metal enters the cavity relative to adjacent surfaces of the cavity. In general, the surfaces need to allow expansion while controlling it, so as to function in the cavity in a manner similar to a gate providing controlled expansion. As such, a controlled expansion region defined by the cavity can be regarded as a pseudo gate and, in general, a reference in the following to a gate is to be understood as covering both an actual gate and such pseudo gate. However, the die cavity surfaces which define a pseudo gate, through which metal flows on entering the cavity, usually will not contain the flow on all sides, although substantial containment such as on three sides is preferred.

A controlled expansion region may be achieved by a sharp, step-wise increase in cross-section from the effective cross-section of the runner. However, it is preferred that the controlled expansion region progressively increases in cross-section in the direction of metal flow therethrough. Thus, where the expansion region is defined by an actual gate, the gate preferably increases in cross-section to a maximum cross-section where the gate communicates with the die cavity.

The invention is applicable to either hot-chamber or cold-chamber die casting. In each case, the invention enables very substantial cost savings in the production of castings of magnesium, as illustrated later herein, as it enables a substantial improvement in the casting yield. Hence the weight of runner/sprue metal which needs to be recycled and re-processed is substantially reduced, a matter of particular relevance in the casting of magnesium due to the care needed in re-processing.

The metal flow system provided by the invention, and used in a casting process according to the invention, usually is substantially provided by a die or mould part or tool which defines part of the die cavity. However, as with conventional pressure cavity moulds and dies, it may be defined by co-operating parts or tools.

The system of the invention may be adapted for use in pressure casting with a given machine. At least where this is the case in the system and process of the invention, the velocity of molten metal through the runner is preferably about 150 m/s. Variation in this velocity is possible, such as within the range of about 140 to 165 m/s. However, the velocity need not prevail through the full length of the runner, although this is preferred in at least some forms of the invention. Rather, it is sufficient if the velocity is attained over part of the length of the runner which has a lesser effective cross-section than exists over other parts of the length.

The velocity of the flow of molten metal through the controlled expansion region may be about 25 to 50% less than the flow through the runner. In many instances, it is found that the metal velocity through the expansion region is very close to two-thirds of that in the runner. Thus, with a runner velocity of about 150 m/s, the expansion region velocity preferably is about 100 m/s.

In the foregoing, there is reference to an effective cross-sectional area of flow through the expansion region and through the runner, as distinct from the physical cross-sectional area of the expansion region and runner. This distinction is important, as reflected by the initial experiments of the first series of experiments outlined later herein. Those initial experiments were conducted with large runners and gates, in accordance with the prior art best practice for casting magnesium alloys and similar to practice for casting aluminium and zinc alloys. The actual flow path in the runners in those initial experiments was through a cylindrical region much smaller in cross-sectional area than the designed physical cross-sectional area of the runners. The much smaller area of the flow region comprised a somewhat centralised core in which the molten metal flowed through the runners, and which was within a sleeve of at least partially solidified metal of substantial wall thickness. For a given runner cross-sectional area, the cross-sectional area of the flow region was larger when the die was hot.

The relevance of the distinction drawn between an effective flow cross-sectional area through a runner, and the actual or designed cross-sectional area, is less pronounced in a runner of the metal flow system of the invention than in the prior art best practice. Indeed, in a limiting situation according to the invention, the distinction can be substantially eliminated. That is, in the limiting situation, the runner can have a relatively small designed cross-sectional area which substantially defines the effective cross-sectional area of flow through the runner. To facilitate attainment of this situation, an upstream part of the length of the runner of a hot-chamber system may be defined by a member formed of a suitable ceramic material which enables maintenance of temperature cycle inhibiting the solidification of metal on surfaces of the member which define the runner. Alternatively, such upstream part of the length of the runner of a hot-chamber, or for a cold-chamber, system may be defined by a member adapted for the circulation of a heat exchange fluid, or by the use of an electric heating device, to enable maintenance of such temperature cycle.

The prior practices have necessitated large runner systems which, in general, have runners of larger cross-section than their gate, that is, the converse of that enabled by the invention with respect to the cross-sections of the runner and controlled expansion region. As a consequence, they have resulted in a relatively large quantity of runner/sprue metal for a given casting and, hence, high costs in recycling and re-processing the runner/sprue metal. The prior practices generally have resulted in runner/sprue metal in excess of 50% of the weight of the casting and over 100% in some instances. That is, the quantity of runner/sprue metal can be greater than that of the casting.

In contrast to the prior art practices, the present invention enables the quantity of runner/sprue metal to be substantially reduced, such as to less than 30% of the casting weight for cold-chamber machines. In many instances, particularly with hot-chamber machines, the invention enables the quantity of runner/sprue metal to be well below this level, for example as low as about 5% or even as low as about 2%. This, of course, provides a significant practical benefit, since the cost of re-processing recycled metal is correspondingly reduced.

The present invention enables the quantity of runner/sprue metal to be substantially reduced as a direct result of reduction in the designed cross-section of the runner, with a further reduction being possible by reduction in runner length. The designed cross-section can be reduced so that it substantially corresponds to the effective cross-section of flow through the runner. However, the effective cross-section of flow need prevail along only part of the length of the runner, such as along a minor part of the length. Also, the part of the length of the runner which is solidified in a casting operation is able to be shortened substantially, to achieve a further reduction in the quantity of runner/sprue metal.

The present invention enables the attainment of important benefits beyond that of reducing re-processing costs. These include a significant improvement in the related parameters of casting porosity and surface finish. Relative to die castings of aluminium or zinc alloys, castings of magnesium produced by prior art practices usually have an inferior surface finish, frequently attributable to porosity at or near the casting surface. However, the present invention enables casting porosity to be substantially reduced and also enables the attainment of a uniform surface finish of good quality.

A common factor in reducing the quantity of runner/sprue metal, reducing porosity and improving surface finish is believed to be the attainment of the molten metal flow velocities enabled by the invention. With such velocities, it is believed that, apart from a region of the die cavity adjacent to the controlled expansion region, metal flow in the die cavity is due to the molten metal being in a viscous state.

Thus the flow in the die is as of a semi-solid front fill with the percentage solids in the flowing metal remaining relatively constant during filling of the cavity. That is, filling of the cavity appears to proceed by semi-solid fronts moving away from the controlled expansion region, in contrast to the highly complex peripheral fill and back-filling encountered with casting of aluminium or zinc alloys.

The invention as detailed herein is based on a range of experiments. A first series of the experiments were aimed at providing a better understanding of the mechanism of flow and solidification of magnesium alloys. Specifically the experiments sought to establish whether improvements to surface finish and porosity levels could be achieved by changing and/or controlling the physical parameters for specific castings.

Some of the initial experiments of that first series used the "short shot" technique to gain understanding of the flow patterns. These experiments resulted in the identification of two flow regimes within the cavity which always produced an area of poor finish between them. The flow pattern was unlike any seen in zinc or aluminium pressure castings. Examination of the microstructure showed that:

- the flow in the runner was through a cylindrical region much smaller in cross-section than the designed physical runner cross-section. This was also noted in sections of the casting in which the flow was uni-directional.
- the percentage solids in the magnesium alloy castings (as demonstrated by dendrites with large dendrite arm spacing) was approximately 50%.
- the microstructure of the magnesium alloy castings near the gate was different from that observed from 50 mm to 300 mm from the gate.

The results of these initial experiments seem to suggest that the metal had partially solidified in the runner and then behaved as a semi-solid within the cavity, with attendant viscous behaviour. The first metal travelling along the runner (the front) appeared to have entered the cavity in a liquid state and hence this could explain the different microstructures obtained and the substantially common position across the casting of the transition between these different flow conditions.

In later experiments of the first series, changes to the style of runners and gating within the traditional gating philosophy resulted in marginally improved castings, whereas large changes were expected in accordance with that philosophy. However, the area and position of poor surface finish remained substantially unchanged. A radical change to a single taper tangential runner produced an extremely good result when considering the quality of the casting, but the product to runner/sprue ratio was not acceptable. The general level of understanding of the flow behaviour at this stage was extremely limited. However, what was apparent is that magnesium alloys behave significantly differently to zinc and aluminium alloys.

A second series of experiments was carried out with a number of different dies and casting machines to try to establish if the difference in behaviour was due to thixotropy. The experiments covered various casting sizes ranging from 15 grams to 15 kg and were carried out on both hot and cold chamber machines. In one of the experiment with a very long casting (approximately 2 m) which comprised a series of open ended boxes, the casting was fed along the long edge in a cold chamber machine. Two large runners from the sprue fed long semi-tapered runners. It was our contention that if the metal was in a thixotropic state in the cavity then it should be possible, due to viscous heating, to fill the casting from one end. To prove this, a section of a previously cast runner was replaced in the die, thus effectively blocking off the metal entry to that half of the cavity. Therefore any metal in the cavity adjacent to the blocked off runner must have entered from the unblocked side, producing flow distances in excess of 1 meter. The flow path in the cavity was extremely complex and exhibited many changes in direction. However, with no change in maching settings, the one sided feeding system produced a casting, the quality of which was superior at its extremes to those produced with complete runners. The significant change noted was an increase in metal velocity.

Additional experiments of a third series were conducted with a casting 280×25×1 mm made in a small hot chamber machine and fed with a long thin runner and extremely thin gates of 0.15 mm deep. These experiments showed that the gate was badly blocked along much of its length resulting in poor quality castings. The runner, which was 220 mm long in one direction, was reduced to an effective length of 100 mm by welding a plug 10 mm long into the runner. The resultant casting was totally filled and metal flowed from the cavity into the unblocked portion of the runner through the 0.15 gate. This demonstrated that the alloy was in an extremely low viscosity state throughout cavity fill. Similar castings in zinc or aluminium alloys would not exhibit this characteristic. It should be noted that the machine exerted a pressure of only 14 MPa on the metal.

Examination of magnesium castings produced by the best practice use of long thin gates invariably show that large sections of the gate in fact are not working.

Further experiments of a fourth series were carried out in a range of castings sizes, but all exhibited that the quality improves when gates and runners are reduced in size and metal velocity increases. Examination of runner cross-sections, ranging from 1×1 mm to 50×50 mm, from a number of castings produced on both hot and cold chamber machines, revealed in each case a central circular region. This characteristic did not appear to be influenced by the original cross-sectional profile. The presumption for this condition is that it defines the region where metal flow occurs during cavity fill and is assumed to be the effective flow cross-section. Because this region is smaller in cross-sectional area than the runner channel as originally cut in the die, metal flow achieves a significantly higher velocity. Calculations, using measured metal flow rates, result in values for runner velocities which cluster around 150 m/sec, with gate velocities being approximately ⅔ that of the runner velocity. Similar regions can be found in castings where there is uni-directional flow.

A fifth series of experiments involved producing a long thick casting through progressively smaller gate sections. The original gated length was reduced from 120 mm to 8 mm and the castings remained of acceptable quality. Micro examination of the castings showed that the filling was consistent with a semi-solid front fill, and the percentage solids during fill remaining constant throughout the part. Porosity was minimal.

In order that the invention may more readily be understood reference now is directed to the accompanying drawings, in which:

FIG. 1 is a sectional view showing part of a die casting system for the production of door handles of magnesium alloy, according to the present invention;

FIG. 2 is a view of the system taken from the right hand side of FIG. 1;

Figure 3:
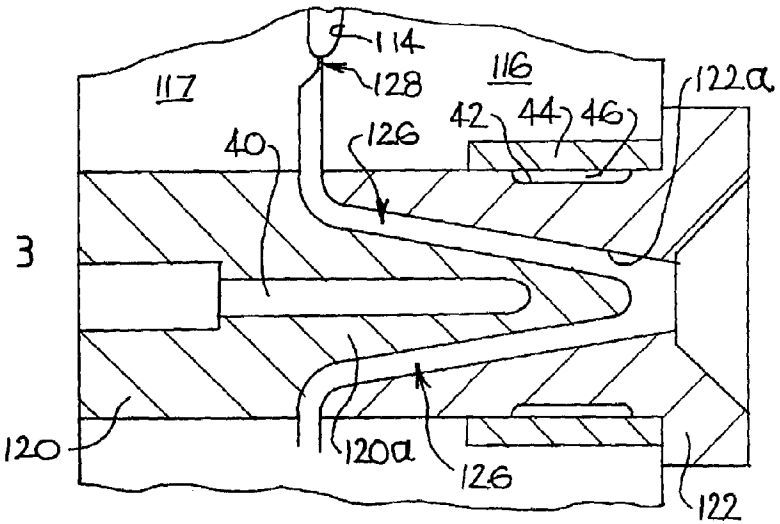
Figure 4:
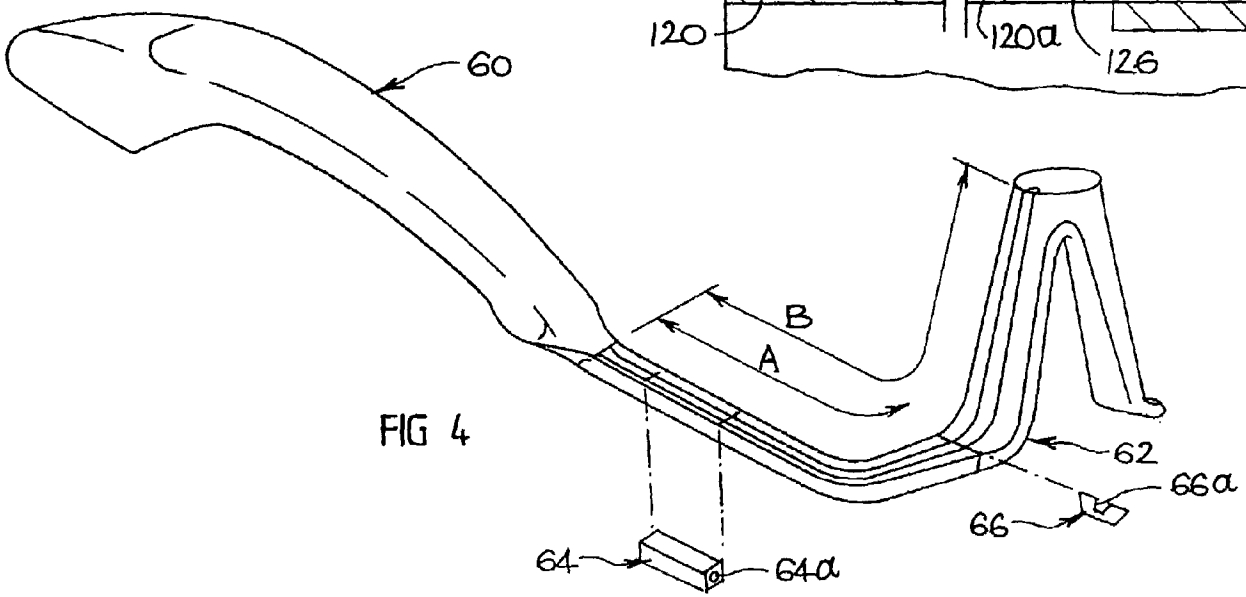
Figure 9A:
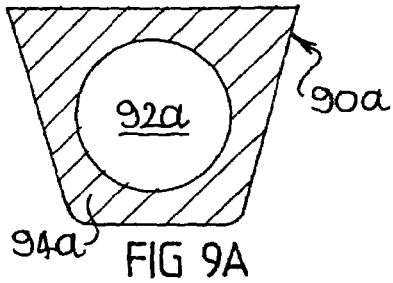
Figure 9B:
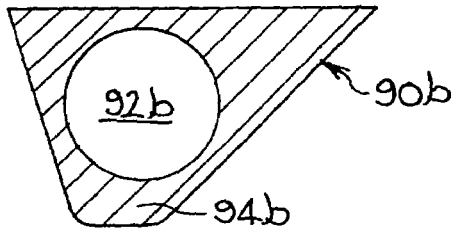
Figure 9C:
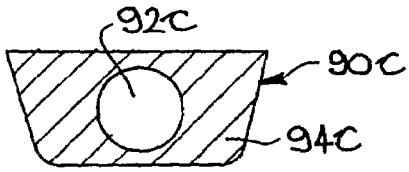
Figure 5:
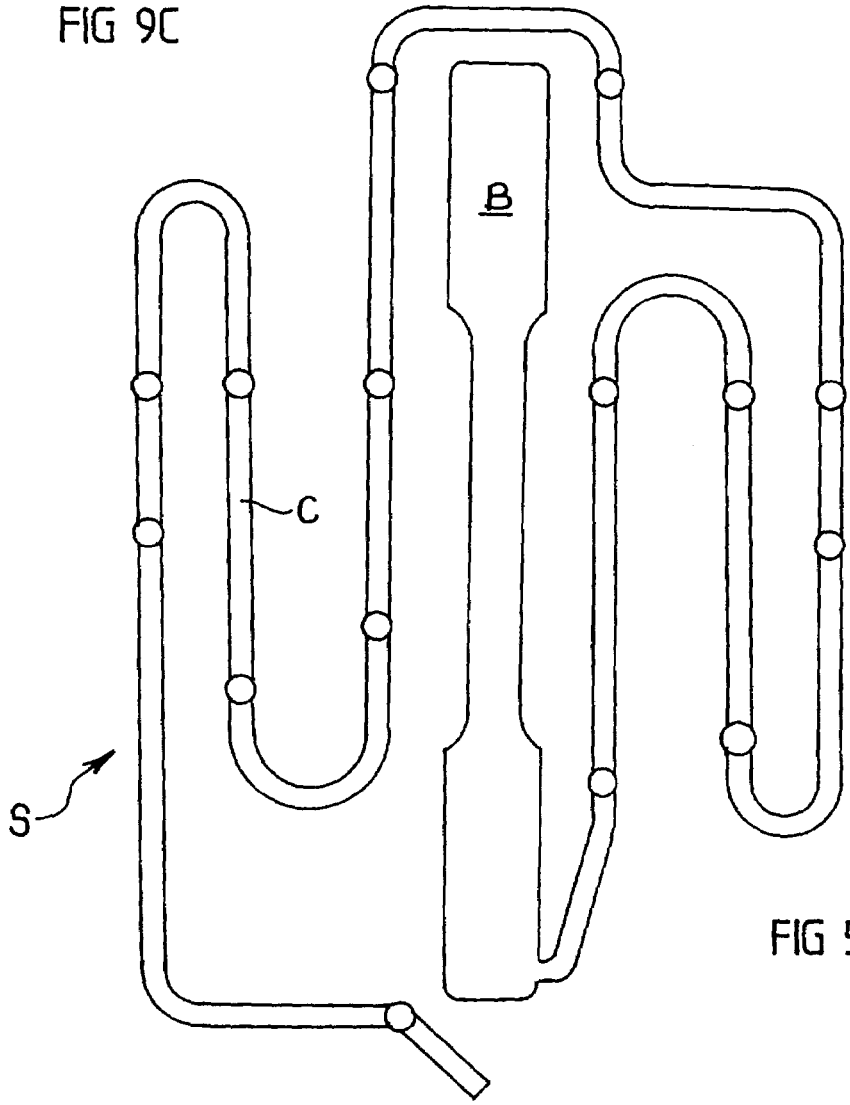
Figure 10:
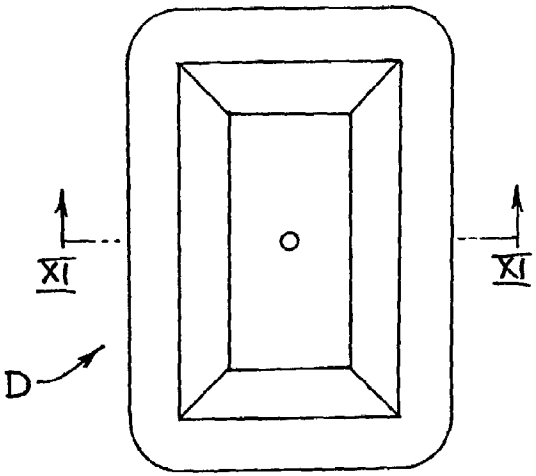
Figure 11:
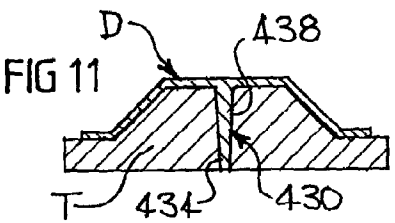
Figure 12:
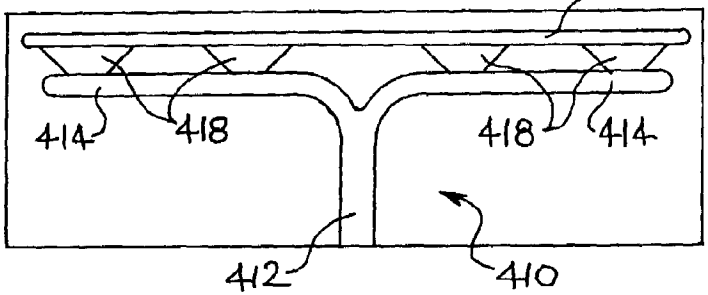
Figure 13:
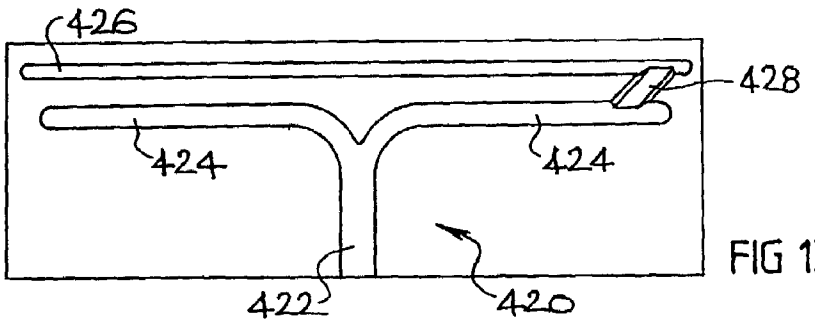
Figure 14:
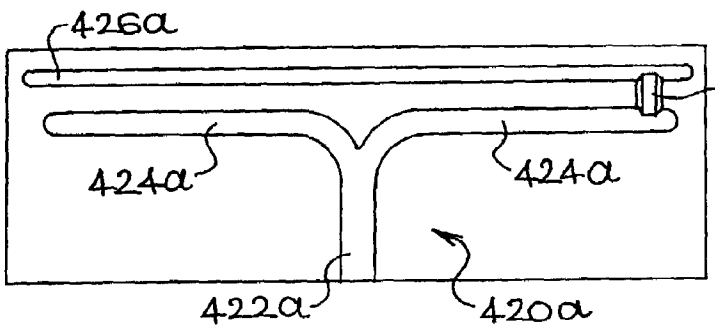
Figure 15:
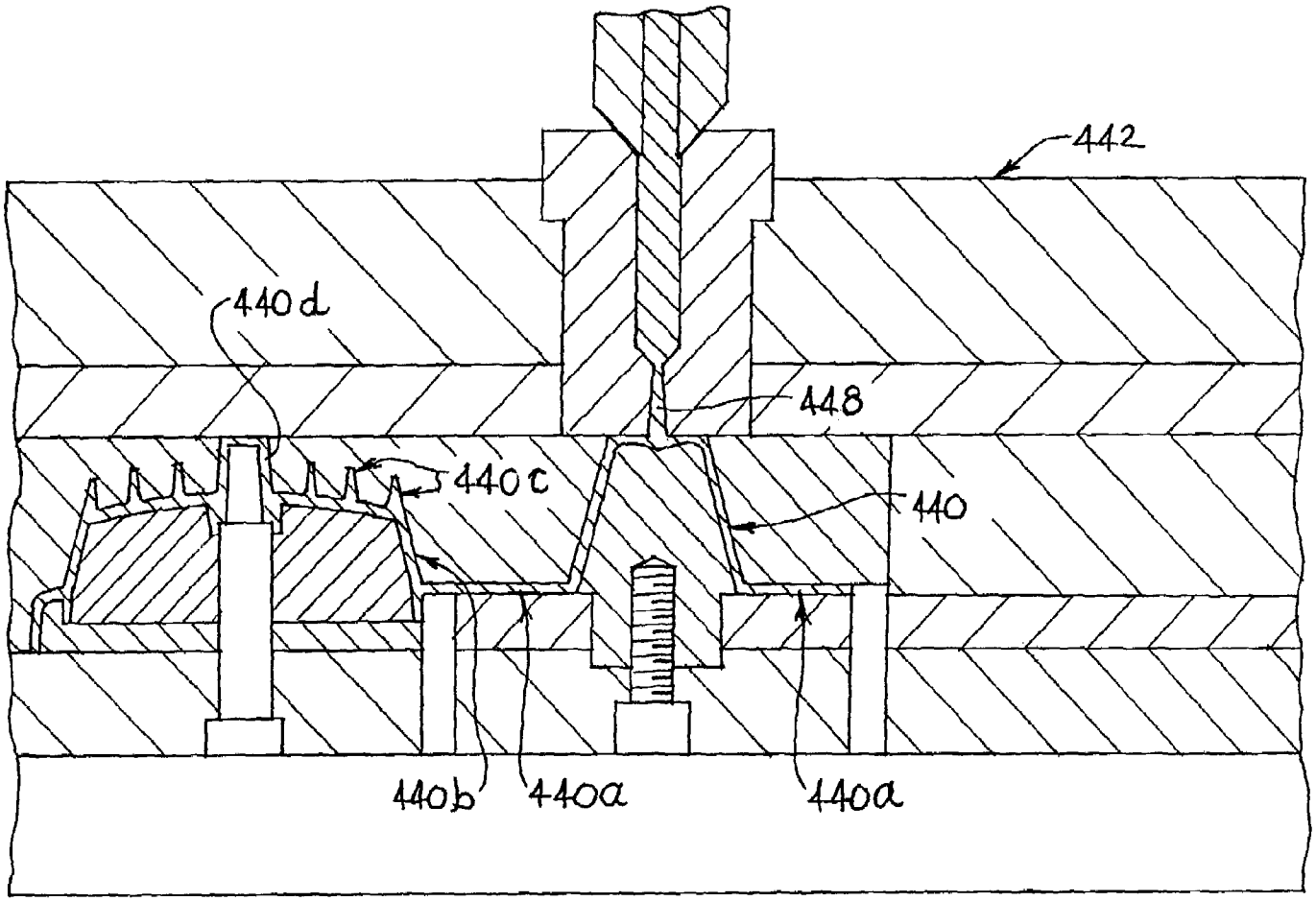
Figure 16:
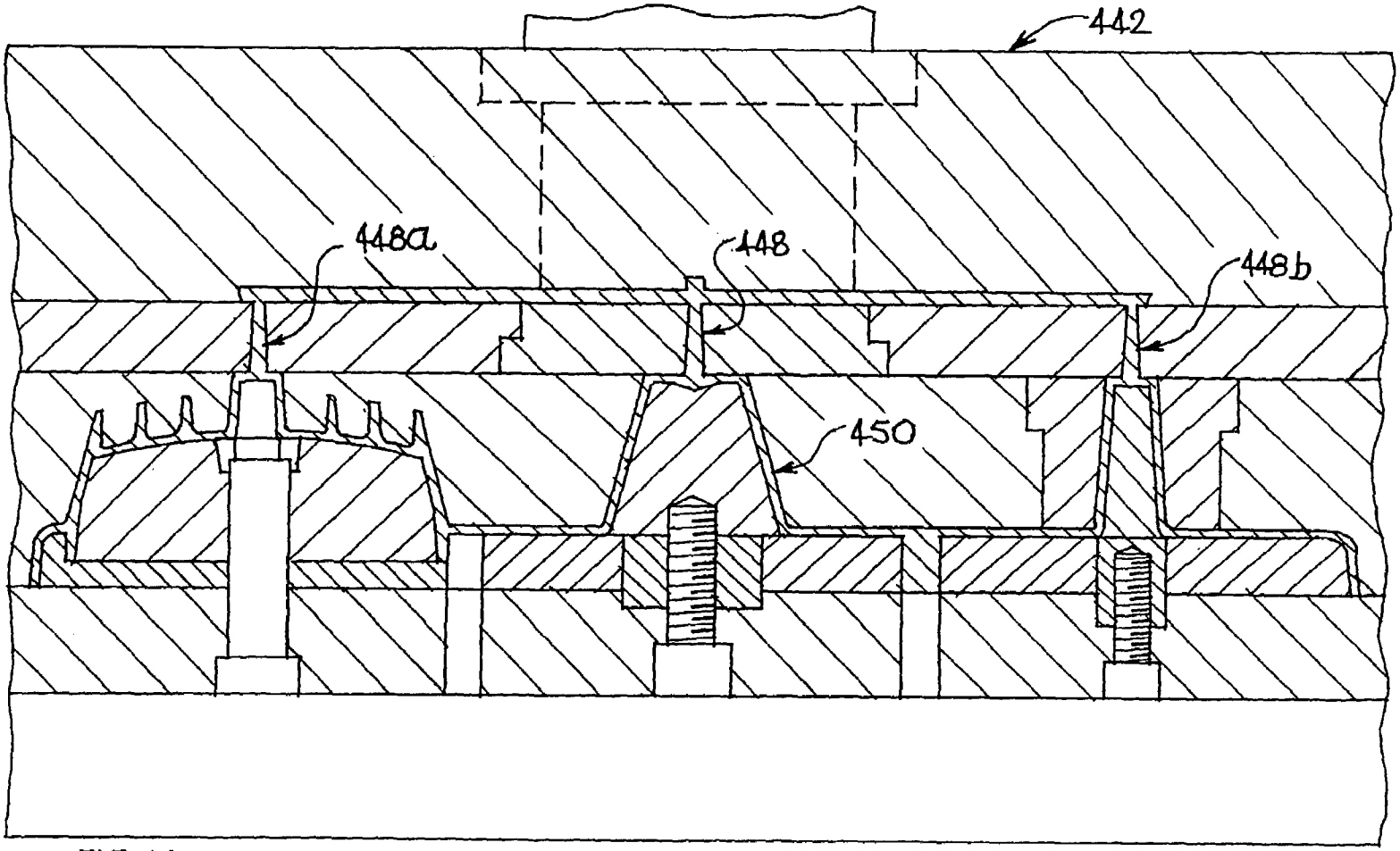

FIG. 3 corresponds to FIG. 1, but illustrates a prior art arrangement;

FIG. 4 is a schematic representation of a cast door handle with attached runner/sprue metal;

FIG. 5 is a schematic representation of an experimental metal flow system;

FIGS. 6 and 7 illustrate further arrangements suitable for use in the present invention;

FIG. 8A schematically illustrates the filling of a die cavity during casting of zinc or aluminium alloy, as traditionally understood;

FIG. 8B schematically illustrates the filling of a die cavity during casting of magnesium alloy in use of the present invention;

FIGS. 9A to 9C illustrate the cross-sectional configuration of typical runners, showing schematically for each the cross-section of its effective flow channel;

FIG. 10 is a plan view of a dish cast from magnesium alloy in accordance with the invention;

FIG. 11 is a sectional view of the dish of FIG. 10 and a die tool, taken on line XI—XI of FIG. 10;

FIGS. 12 to 14 illustrate respective experimental metal flow systems;

FIG. 15 is a sectional view of a die casting die suitable for a hot-chamber machine, for use in the present invention; and FIG. 16 is similar to FIG. 15, but illustrates a modified, larger casting able to be made with the die of FIG. 15, using a cold-chamber machine.

In the system 10 of FIGS. 1 and 2, there is shown a die 12 which defines a number of radially disposed cavities 14 (of which only one is shown) in each of which a respective door handle, somewhat of the form shown in FIG. 4, is able to be cast. Die 12 has a fixed part 16 and a movable part 17 and is shown in its closed condition, but its parts 16, 17 are able to separate on parting line P. A plug 20 incorporated in die part 17 has an ejection pin 18 slidably mounted therein; pin 18 and at least one further pin (not shown) being extendible for ejecting a casting at the end of each operating cycle.

Opposed to plug 20, die part 16 includes a bush 22, the bore 22*a* of which is lined with a sleeve 24. While bush 22, like plug 20, is made of a suitable steel such as used for parts 16, 17 of die 12, sleeve 24 preferably is made of a material of relatively low thermal conductivity, such as partially stabilised zirconia or other suitable ceramic.

The adjacent ends of plug 20 and bush 22 are of complementary frusto-conical form. Their ends are such that, with die 12 closed, plug 20 and bush 22 achieve a seal between contacting opposed end surfaces. However, the end surface of plug 20 defines a respective groove 21 for each die cavity 14, with the groove 21 co-operating with the end of bush 22 to define a runner 26 for that cavity 14. The runner 26 communicates with the cavity 14 via a gate 28.

Concentrically within bore 22*a* of bush 22, sleeve 24 defines a bore 24*a* of substantially smaller cross-section. Also, the outer end of bush 22 defines an outwardly-flared enlargement of bore 22*a*, to enable its engagement with a nozzle 30. As will be appreciated, nozzle 30 forms an extension of a gooseneck/plunger arrangement (not shown), of a hot-chamber die-casting system, by which molten magnesium is able to be injected through bore 24*a* to cavity 14, via runner 26 and gate 28.

On completion of a casting cycle with the arrangement of FIGS. 1 and 2, injected magnesium is solidified back to the inner end of bore 24*a* of sleeve 24. Thus, on release of the casting pressure during the cycle, molten metal is withdrawn, through nozzle 30, from bore 24*a*.

With the arrangement of FIGS. 1 and 2, the length of each runner 26 is able to be a minimum. Also, each runner is able to have a designed cross-section as small as the cross-section of the effective metal flow through each runner 26. An inner end portion of each runner 26 is defined by parts 16, 17 of die 12. Over the length of that portion, the runner 26 progressively reduces in depth, but increases in width, such that gate 28 is of narrow elongate form having a larger cross-section than the part of the length of the runner 20 defined between plug 20 and bush 22.

In use with the arrangement of FIGS. 1 and 2, heat energy extraction for solidification of runner/sprue metal is by conduction to parts 16, 17 of die 12, via plug 20 and bush 22. The relatively short length and small cross-section of runners 26 is such that circulation of coolant to achieve solidification may not be necessary. However, despite the relatively short length of runner 26 and, hence, the proximity of sleeve 24 to cavity 14, solidification of metal in bore 24*a* is able to be prevented by the insulating effect of the ceramic of which sleeve 24 is made. The overall arrangement of FIGS. 1 and 2 is such that in the casting of magnesium alloy handles having a weight of about 30 gm, the length and cross-section of each runner 26 is such that the quantity of runner/sprue metal (for two simultaneously cast handles) is able to be reduced to about 3 gm.

FIG. 3 corresponds generally to FIG. 1, but shows detail of an arrangement in accordance with prior art practice. In FIG. 3, components corresponding to those of FIGS. 1 and 2 have the same reference numeral plus 100.

In the arrangement of FIG. 3, plug 120 has a frusto-conical sprue pin 120*a* which, with parts 116, 117 of die 120 closed, projects into tapered bore 122*a* of bush 122. Plug 120 has grooves 121 formed therein which, with bush 122, define runners 126. Plug 120 also has a duct 40 formed therein for the circulation of coolant, such as water, while bush has a peripheral groove 42 formed therearound, with groove 42 covered by a sleeve 44 to define a further duct 46 for circulation of coolant.

As will be appreciated, a nozzle (not shown), similar to nozzle 30 of FIG. 1, is used to enable molten magnesium alloy to be injected through bore 122*a*, along runners 126, and into die cavity 114 via gate 128. On completion of filling, coolant is circulated through ducts 40, 46, to solidify runner/sprue metal through to the minimum cross-section of bore 124*a*, between the tapered portion receiving pin 120*a* and the flared outer end for receiving the nozzle of a die-casting system.

With the prior art arrangement of FIG. 3, runners 126 are not only longer, but also of larger cross-section. As indicated, this is to avoid a perceived risk of premature freezing of low heat capacity magnesium alloy. In case of that arrangement in the casting of door handles of a form and weight the same as that of the handles referred to in respect of FIGS. 1 and 2, the weight of runner/sprue metal is about 30 gm. That is, 10 times the quantity of metal needing to be recycled with the arrangement of FIGS. 1 and 2 is encountered with the arrangement of FIG. 3.

FIG. 4 shows schematically a magnesium allow door handle casting 60 as released from its die cavity and still having attached thereto its runner/sprue metal 62. The runner/sprue metal 62 is common to two castings 60, but only one of the latter is shown, while the full extent of runner metal for the casting other is not shown.

The runner of the metal flow system, as originally formed, had a designed cross-section having an area of 50 $mm^2$ and corresponding in external profile to the form shown in FIG. 9C and described later herein. As is evident from FIG. 9C, the designed cross-section of the runner is that of a regular trapezium, with such cross-section existing throughout the length of the runner.

A sixth experiment was aimed at illustrating the effect of viscous flow on the distance magnesium alloy would travel during casting. For this there was created a metal flow system S as shown in FIG. 5, consisting of a channel C providing a metal flow path ending in a standard tensile bar impression B. The channel C had a nominal cross-section of 4×4 mm and a length of 1230 mm.

Casting trials were carried out with the system S of FIG. 5, on a 250 tonne cold chamber die casting machine. The trials were conducted under normal operating conditions for the machine, while the die temperature was only about 120° C. As will be appreciated from FIG. 5, the path of channel C is of a tortuous nature, creating high resistance to flow. Despite this, flow along the full 1230 mm length of the channel C was achieved, enabling filling of the bar impression B to commence. The flow length of 1230 mm is considered not to be a limit. However, it is contrasted with an observed flow length maximum of about 700 mm designed in accordance with conventional practice and resulting in a runner cross-section very much larger than 4×4 mm.

A seventh series of experiments was carried out, with door handle castings 60 of FIG. 4, to determine the minimum size of runners and gates able to produce saleable castings. The experimental set up consisted of:

- 80 tonne Frech Hot Chamber Machine with a melting furnace connected to the holding furnace via a siphon pipe. This meant a consistent metal temperature.
- DieMac shot monitoring system which gave plunger displacement, velocity and pressure.
- Two thermocouples in the fixed half of the die, both 7 mm from the impression surface and 10 mm and 80 mm from the gate into the casting cavity.
- Chart recorder to display the temperatures with time.
- Contact thermocouples for surface measurement of temperature
- Infra red digital temperature sensors
- Fully equipped tool room for alterations to the die and preparation of inserts.

The following experiments of the seventh series were carried out all with a gate velocity of about 100 m/s:

1) Feeding in the end of the casting 60 with a 2×1 mm gate gave resultant castings which were of reasonable quality but not saleable. The sprue and runner section were of the same approximate weight as the casting (50% yield).
2) Feeding in the end of the casting with a 7×2 mm gate gave castings which were of high quality and saleable. Soldering was observed in one area and this was overcome by the addition of a cooling fountain in the area which had the effect of reducing the die temperature. Sectioning the runner revealed a cylindrical flow pattern (described herein with reference to FIG. 9C) which represented a real runner velocity in the order of 150 m/s. If then the effective diameter of the runner was reduced to approximately 3 mm (this being the observed diameter of the cylindrical section) the insertion of a physical port of 3 mm diameter should have no effect on the quality of the casting. Hence a part of a runner was taken to provide a segment 64 and a hole 64*a* of 3 mm diameter was drilled through it so as to produce a 3 mm diameter flow channel. The segment 64 was inserted in the runner, adjacent to the gate, so that its hole 64*a* formed a part of the length of the runner along which it had a reduced cross-section in which the effective flow of metal had a cross-sectional area of not more than about 7.1 $mm^2$. Also within this experiment a number of short shots were produced by reducing the amount of metal into the cavity. The short shots from insufficient metal appeared to comprise a skin section which may be due to metal impingement. This, due the high gate velocity of 100 m/s could result from either a liquid or semi-solid flow.
3) A normal runner was used, but with a segment 64, having a 3 mm diameter hole 64*a*, inserted in the runner feeding a 7×2 mm gate. The casting was of relatively high quality with low porosity as determined from sectioning. Some of the surface marks in the area furthest from the gate suggested that the flow might have been disturbed to a relatively small extent. This was carried out for 6 shots with normal production between each one to maintain die temperature. It was believed that the sharp entry and exit to the 3 mm diameter hole could have contributed to the defects. The pressure required to push the metal through the runner and gate was approximately 20% higher than normal production.
4) In a further experiment, a longer runner piece of length A and with a 3×3 mm channel cut into one side was inserted to a 7×2 mm gate. The runner piece had a transverse cross-section as shown at 66, with the channel depicted at 66*a*. The inlet and exit sections of the runner piece were relieved so as to produce less resistance to the flow. The casting quality was extremely good and of saleable quality. The pressure required to drive the metal through the runner and into the cavity increased by approximately 30% over normal. One runner of a casting produced using the runner insert was sectioned and it appeared that the metal had flowed through the section with minimal solidification along the walls of its channel. The velocity through the runner was calculated at 150 m/s and in the gate of 100 m/s.
5) In another experiment, a full runner and sprue of length B and with a 3×3 mm channel was used to feed a 7×2 mm gate, with total length of flow of 120 mm through the 3×3 mm section. Due to the reduced volume of metal in the sprue area the water cooling to the sprue post was removed. The casting was of exceptional quality. The quality of this casting was considered to be superior to any other previously made. The surface defects noted in experiment 3 of this series were not present in this case. The pressure required to fill the cavity was 30% higher than normal. The feed system was 6% of the casting weight (94% yield).

It appears that the molten metal entering the runner solidifies rapidly on the runner surfaces so that a channel is formed. If the metal in this central region is semi-solid then a rapid increase in viscosity will occur for solid percentages of greater than about 50%. If the velocity is kept high then viscous heating occurs, counteracting further loss of heat to the die walls. Thus the metal could flow for long distances. In each of the runners observed throughout this work, with no machine setting changes, the equivalent runner left gave a metal velocity in the order of 150 m/s. By inserting a runner section into the die, the velocity in the runner was set at 150 m/s from the start. The casting should have been of at least equivalent quality as that produced under "normal" conditions. The improved quality observed may have been due to the rapid reaching of an equilibrium condition of runner velocity 150 m/s and gate velocity of 100 m/s. This reduction in velocity prior to reaching the cavity can be used so that the velocity reduces from the runner, through the gate and into the cavity.

The best runner design previously was one that had continuously increasing velocity along the flow path so that no entrapment of air could occur at the fragmenting metal front. The runner velocity was no more than 50% of the gate velocity in most of the runner. However the work detailed herein shows that a high runner velocity can be employed with a corresponding improvement in casting quality.

The further respective arrangement of each of FIGS. 6 and 7 generally will be understood from a consideration of FIGS. 1 and 2, and components corresponding to those of FIGS. 1 and 2 have the same reference numerals plus 200 in the case of FIGS. 6 and 300 in the case of FIG. 7.

The arrangement of FIG. 5 differs from that of FIGS. 1 and 2 in that bore 224*a* of ceramic sleeve 224 varies in diameter to facilitate clear separation of withdrawn molten metal from solidified runner/sprue metal. Thus, over a major part of its length from its outer end, bore 224*a* has a large diameter in which the correspondingly large volume of molten metal is able to be kept liquid. Bore 224 then is stepped down to a minimum diameter, for a short length, and then through to its inner end it increases to an intermediate diameter. Where the extraction of heat energy for solidification of runner/sprue metal is such as to cause some solidification into bore 224*a*, the arrangement of FIG. 6 effectively limits the extent of this. That is, solidification is unable to proceed beyond the short minimum diameter section, at least in the short time available in a casting cycle, due to the heat energy content the volume of metal in the large outer end portion of bore 224*a*.

The arrangement of FIG. 7 achieves a similar benefit to that of FIG. 6, with separation of solidified and still molten metal occurring at the minimum diameter of bore 324*a* of ceramic sleeve 324. However, it is preferred because of the overall simplified form. As shown, plug 320, bush 322 and sleeve 324 have parallel end faces which, with die 312 closed, abut on parting line P. Compared to FIG. 3, there can be a considerable saving of remelt metal of up to about 95%.

Each of FIGS. 8A and 8B illustrates schematically the pattern of die cavity filling, with zinc or aluminium alloy in the case of FIG. 8A and with magnesium alloy and use of the present invention in the case of FIG. 8B. The systems shown depict a respective die 70*a* and 70*b* having parts 72*a*, 74*a* and 72*b*, 74*b* which define a mould cavity 76*a* and 76*b* and are separable on parting plane P. Molten alloy is able to be injected into the respective cavity 76*a*, 76*b*, in each case, through a metal flow system which includes a runner 78*a*, 78*b*, and an ingate 80*a*, 80*b*.

In the case of FIG. 8A, runner 78*a* is of large cross-sectional area relative to the volume of cavity 76*a*, and molten alloy is injected from runner 78*a* through a gate 80*a* of smaller cross-section. The flow of alloy, depicted by the shaded area, is in accordance with the traditional filling pattern recognised for casting of zinc and aluminium alloys. That is, a stream 82 of alloy is injected through cavity 76*a* to a region of the cavity remote from gate 80*a*, with a peripheral flow 84 of alloy then back-filling the cavity. Despite this complex peripheral fill and back-filling, quality castings can be produced with zinc and aluminium alloys. However, as indicated above, such complex filling produces less than optimum quality castings of magnesium alloys.

In the case of FIG. 8B, runner 78*b* is of a small cross-sectional area relative to the volume of cavity 76*b*. Molten magnesium alloy is injected from runner 78*b* through a gate 80*b* of larger cross-section. The cross-section of gate 80*b*, in addition to being larger than that of runner 78*b*, also may be larger than that of gate 80*a* of FIG. 8A for a given die cavity volume. The flow of magnesium alloy, again depicted by the shaded are, is in a viscous or semi-sold state. In that state, the flow builds up a body 86 of alloy which increases in volume away from gate 80*b*, to generate a semi-solid front 88 which moves away from gate 80*b* to remote regions of cavity 76*b*.

In the experiments according to the invention detailed herein, a range of casting forms and sizes was involved. As indicated, the experiments were with both hot-and cold-chamber machines. In each case, die cavity filling appeared to have proceeded substantially as described with reference to FIG. 8B. However, a small initial quantity of the magnesium alloy, in at least some of the castings, appeared to have entered the cavity in a more liquid state than a semi-solid state. That initial quantity, where indicated, was evident from a skin section adjacent to the gate of somewhat different microstructure (but otherwise of good quality) to the remainder of the casting.

The flow described with reference to FIG. 8B is achieved where an alloy flow rate is at about 140 to 165 m/s, preferably about 150 m/s, in the runner and 25 to 50% less, such as about two-thirds of the runner flow rate, through the gate. As indicated, this is achieved in a cylindrical core region through the runner, such as illustrated in FIGS. 9A to 9C. Each of these Figures shows the cross-section of respective runners 90*a*, 90*b* and 90*c*. Solidification of alloy in the runner on completion of a casting operation, and cutting of the runner to provide such cross-section, shows a respective such cylindrical core region 92*a*, 92*b* and 92*c*. These regions represent for each runner an effective flow channel to which alloy flow has been constrained substantially throughout die cavity filling in a casting operation. This constraint comes into being after a short period of initial flow, during which at least partially solidified alloy 94*a*, 94*b* and 94*c*, as depicted by shading, builds up on surfaces defining the cross-sectional profile of the runner.

The cylindrical form a flow regions 92*a*, 92*b* and 92*c* is found to be of well-defined circular cross-section, regardless of the profile of the runner in which, it is produced. FIGS. 9A to 9C show typical runner profiles in which regions 92*a*, 92*b* and 92*c* of circular cross-section have been achieved. It is evident from these profiles that the cross-sectional area of the designed profile of the runner can be reduced without significant impact on the cross-sectional area of regions 92*a*, 92*b* and 92*c*, but with reduction of the quantity of resultant runner/sprue metal. That quantity is able to be further reduced with benefit, as detailed herein, by reduction in the designed length of the runner. The following details illustrate the extent to which such reductions can be achieved.

Magnesium alloy castings of 1.6 kg weight, in the form of a 450 mm high, 400 mm wide open frame structure, with wall thickness varying from 2 to 20 mm and having very deep sections, were produced on a cold chamber machine. Using a traditional form of runner/biscuit, the quantity of runner/sprue metal was 1.1 kg such that the casting represented a yield of 60% in terms of the percentage of metal consumed in the casting operation. That is, about 40% of the metal consumed need to be recycled. With a runner/biscuit according to the invention, the quantity of runner/sprue metal was 0.36 kg, giving a yield of 82% and a reduction of about 67% in the quantity of alloy needing to be recycled.

Castings of door handles of the form shown in FIG. 4 were produced in a hot chamber machine by two impression casting. Each handle had a weight of 28 g, giving a product weight of 56 g per casting cycle. When produced with a traditional metal flow system, each cycle produced 30 g of runner/sprue, providing a yield of 65%. With a metal flow system according to the present invention, such as illustrated in FIG. 7, the quantity of runner/sprue metal was reduced to 1.5 g, giving a yield of 97% and, relative to the traditional arrangement, a 95% reduction in recycled alloy.

An eighth series of experiments was carried out to determine if it was possible to direct metal flow in a die cavity as in normal practice, and to determine the effect of a number of alternative metal flow systems. In this series, a "soap dish" shaped die cavity was used. The form of the cavity is evident from the plan view of a cast dish D as shown in FIG. 10, and the sectional view through the dish D and a male die tool T, shown in FIG. 11, taken on line XI—XI of FIG. 10. The dish D has a length of about 140 mm, a width of about 100 mm, a depth of about 26 mm and a wall thickness of about 2 mm. It has a horizontal peripheral flange, with side walls inclined at about 450 to the flange and a flat base.

A conventional procedure for producing dish D would be to use a metal flow system including a main runner feeding into tapered tangential runners, with the tangential runners extending in opposite directions along a common side edge of the die cavity and feeding along their lengths through a long thin gate to the cavity. In a first trial, a modified version of current best practice is illustrated by the flow system 410 shown in FIG. 12. As shown, system 410 has a main runner 412 which feeds into two oppositely extending tangential runners 414 which are disposed along a side edge, depicted at 416, of a die cavity for producing the dish D of FIG. 10. Each runner 414 feeds two wedge or fan shaped gates 418 which are directed across the cavity. Each gate 418 varies in cross-section from about 6×1 mm at its runner to about 10×0.5 mm at the edge 416 of the cavity. If typical of current best practice, each runner 414 would have a normal cross-section tapering in the direction of metal flow therealong from about 10×10 mm to about 8×10 mm. With such runners 414 and gates 418, production of a dish D of servicable quality would be extremely difficult. However, as indicated above, the system 410 is modified.

The modification is to reduce the nominal cross-section of runners 414 to 3×3 mm. This modification is partially in accord with the present invention, in terms of runner cross-section. However, it does not accord with the invention since the runner cross-section exceeds that for each gate 418. The system 410 of FIG. 12, despite the modification, did not produce satisfactory castings.

In a second arrangement of the eighth series, a system 420 as in FIG. 13 was used. System 420 of FIG. 13 differs from system 410 of FIG. 12, in that only a single entry, chisel gate 428 was provided. As shown, gate 428 was disposed at about 45° to its runner 424, adjacent the extreme end of the runner 424 and cavity edge 426, but directed towards the adjacent end edge of the cavity. The gate 428 had a nominal cross-section of 1.5×4 mm, such that it also was less than the 3×3 mm nominal cross-section of its runner 428 (and of the other, blind runner 428).

If gate 424 of system 410 were to provide directional flow of magnesium alloy, as in normal practice, system 410 would prove to be quite unsatisfactory. That is, metal flow from gate 428 would proceed along the adjacent end to the far side of the cavity, along the far side to the other end, along the other end to the near side having edge 426, and along the near side towards gate 428. However, poor filling of the central region of the die cavity would be achieved, resulting in an unsatisfactory casting. However, system 420 was found to produce better castings of dish D than system 410 of FIG. 12, although the casting was not of servicable quality.

In a third arrangement of the eighth series, a system 420*a* as in FIG. 14 was used. System 420*a* differs from system 420 of FIG. 13 only in that chisel gate 428*a* is at 90° to its runner 424*a* and therefore parallel to the adjacent end edge of the cavity. As in system 420, gate 428*a* had a nominal cross-section of 1.5×4 mm, such that it was less than the 3×3 mm nominal cross-section of its runner 428*a* (and of the other, blind runner 428*a*). The system 420*a* of FIG. 14 provided a superior castings clearly of servicable quality.

The evidence of the flow patterns obtained in each of the eighth series of experiments is that magnesium alloy flow in the cavity is not directable. That is, the pattern of die cavity filling is quite unlike that described with reference to FIG. 8A but, where possible, the flow is as described with reference to FIG. 8B. In the case of the trial illustrated in FIG. 12, satisfactory flow was not able to be achieved, due to the absence of a suitable controlled expansion region. In the case of the trial illustrated in FIG. 13, and even more clearly so with that illustrated in FIG. 14, such a region was present. However, in each case, the region was defined in the die cavity, rather than by gate 428 of FIG. 13 or gate 428*a* of FIG. 14, with the region bounded on three sides by the top and bottom surfaces of the die cavity and the adjacent end edge surface of the cavity. Also, in the case of FIG. 13, the effectiveness of the expansion region in the die cavity appears to have been diminished in its effectiveness, reducing the casting quality, as a consequence of turbulence generated by the flow being directed at the adjacent end of the cavity.

In the systems of FIG. 13 and FIG. 14, neither gate 428 nor gate 428*a* in fact is a gate as required by the present invention, in that it does not provide a controlled expansion region. Indeed, relative to runner 428 or runner 424*a*, respectively, it constricts flow and such region as is obtained is beyond each of gate 428 and gate 428*a*. In terms of the present invention, it therefore is more appropriate to regard gates 428 and 428*a* as a terminal end portion of runner 424 and runner 424*a*, respectively, feeding directly to a controlled expansion region and there effectively being no gate present.

Returning to FIG. 11, there is illustrated therein the basis for a ninth experiment which, like the eighth experiment, was directed to producing dishes D cast from magnesium alloy. FIG. 11 illustrates a metal flow system 430 in accordance with the invention. In system 430, a final part of the magnesium alloy flow path is shown, with this including a runner 434 of circular cross-section having a diameter of 3 mm, which communicates with the die cavity, through tool T, via a gate portion 438. From runner 434, gate 438 increases in diameter in the flow direction and has a diameter of 5 mm at its outlet end at the die cavity.

As with the eighth experiment, the dish D made with the arrangement of FIG. 11 was cast in a cold chamber machine. The system 430 is a radical departure from the prior art pressure casting techniques for metals, and would not be used under current best practice. Despite this, system 430 produced high quality dishes D of magnesium alloy in successive casting trial cycles, indicating its substantial potential for high speed repetitive casting on a commercial scale.

As with the ninth experiment, a tenth experiment was directed to the production of a magnesium alloy casting by direct feeding through a pin gate. In this case, as shown in FIG. 15, a large casting 440 with broad flat areas 440*a* and a difficult box shaped area 440*b* with cross-ribs 440*c* and a boss 440*d*, was produced on a Frech 80 tonne hot chamber machine. The projected area of the casting 440 was 390 $cm^2$ which is greater than recommended by Frech for this machine.

The casting 440 of FIG. 15 was designed to test the effect of flow distance and flow characteristics in a complex shape. The tool 442 used to define the die cavity for the casting 440 was a three plate die which enabled direct casting via single pin gate 448. However, the tool 442 also enabled casting 440, or a casting 450 of a larger form as shown in FIG. 16, using three pin gates 448, 448*a* and 448*b*, on a Toshiba 250 tonne cold chamber machine.

Satisfactory castings as in FIG. 15 were produced. However, directionality was not controllable within the normal expectations of pressure casting. The actual flow indicated a number of discrete continuous front fill patterns, according with previous experiments and similar to those found in plastic moulding. There were extended flow lengths, which accorded very well with observations on experiment six. The flow through the complex shape of boss 440*d* also showed similarity to plastics moulding, in direct contrast to that of pressure diecasting.

In the tenth experiment there was no flashing of the die, despite the large and complex form of the casting made. This and other observations point to the fact that the magnesium alloy being cast did not behave as a classical liquid. A further outcome of the tenth experiment is that it was apparent that the pressure in the die cavity was considerably less than predicted for the magnesium alloy in its molten state, i.e. liquid. Even at full machine injection pressure the casting, at 390 $cm^2$ projected area, did not flash despite the nominal bursting force (assuming a liquid) being greater than the stated locking force of this Frech machine.

The tenth experiment, in particular, highlights a further practical benefit obtainable with the present invention. The absence of flashing indicates that the nominal bursting force, i.e. that which is to be expected for a liquid, is very much higher than the actual force prevailing with casting magnesium alloy in accordance with the present invention. As a consequence, larger castings than expected may be able to be produced on a given machine.

The flow distance and the quality of the casting obtainable with the invention appear to be relatively independent of the die temperature. However, there can be regions of the die in the hot chamber casting where care must be taken in both heating and cooling. In both the direct feed of the ninth and tenth experiments and the edge fed runner of the eighth experiment, the molten metal must solidify at a position that enables that part to be removed from the die but also allow the molten metal to flow back into the gooseneck. As with normal high pressure die casting the use of a cooling medium and a heating medium must be applied to the entry to the die to effect the result. The method used will depend on the make and size of machine as well as the complexity and size of the die.

Finally, it is to be understood that various alterations, modifications and/or additions may be introduced into the constructions and arrangements of parts previously described without departing from the spirit or ambit of the invention.

The invention claimed is:

1. A metal flow system, for use in pressure casting of magnesium alloy in a pressure casting machine selected from hot chamber and cold chamber die casting machines and having a supply of molten magnesium alloy and a mould or die which defines a die cavity;

wherein the metal flow system includes a die or mould tool means which defines:

(I) a runner adapted for receiving molten magnesium alloy under pressure from the supply of the pressure casting machine, and (ii) a controlled expansion region through which alloy received from the runner is able to pass before being injected through a gate defining an inlet to the die cavity;

wherein the flow system has a form providing for control of alloy flow velocities therein, said form of the flow system comprising:

(I) an effective cross-sectional area of the runner for determining the flow velocity of alloy received under pressure therein from the supply of the pressure casting machine; and (ii) a form of said expansion region which enables alloy flow therein to spread laterally, with respect to its direction of injection, and thereby undergo a reduction in flow velocity in the expansion region relative to the alloy flow velocity in the runner such that said flow velocity in the runner and said reduction in flow velocity in the expansion region change the state of the alloy from a molten state in the runner into a semi-solid state for flow through the gate and into the die cavity.

2. The system according to claim 1, wherein the flow system includes said gate and the controlled expansion region terminates at the gate.

3. The system according to claim 2, wherein the gate and runner are such that an effective cross-sectional area of flow through the gate exceeds an effective cross-sectional area of flow through the runner whereby the alloy has a velocity through the effective cross-sectional area of flow through the runner which exceeds its velocity through the gate.

4. The system according to claim 3, wherein the cross-sectional area of flow through the gate exceeds the effective cross-sectional area of flow through the runner to an extent resulting from a ratio of those areas in the range of about 2:1 to 4:1.

5. The system according to claim 1, wherein the controlled expansion region is provided by a step-wise increase in cross-section from the effective cross-section of the runner whereby a step-wise said reduction in flow velocity is enabled.

6. The system according to claim 1, wherein the controlled expansion region progressively increases in cross-section in the direction of alloy flow there through, whereby a progressive said reduction in flow velocity is enabled.

7. The system according to claim 1, wherein the system is adapted for use in pressure casting with a given machine with which it is operable to achieve a velocity of alloy through the runner with the range of about 140 m/s to 165 m/s.

8. The system according to claim 7, wherein the system is so adapted whereby the velocity in said range is about 150 m/s.

9. The system according to claim 1, wherein the system is operable to achieve a flow velocity of alloy through the controlled expansion region which is about 25% to 50% less than the velocity of flow through the runner.

10. The system according to claim 9, wherein the system is so operable whereby the velocity through the controlled expansion region is about two-thirds of the velocity through the runner.

11. The system according to claim 1, wherein the runner has a designed cross-sectional area which substantially defines the effective cross-sectional area of flow there through.

12. The system according to claim 1, wherein said system is operable to achieve filling of the die cavity by moving semi-solid fronts of metal.

13. A metal flow system, for use in pressure casting of molten magnesium alloy, using a pressure casting machine selected from hot chamber and cold chamber die casting machines and having a mould or die which defines a die cavity, wherein the system includes a die or mould tool means which defines:

(a) at least one runner of the system through which molten alloy is able to flow under pressure from the supply of the pressure casting machine; and (b) at least one controlled expansion region of the system through which alloy lows from the runner before flowing to and in the die cavity;

wherein the controlled expansion region is of a form whereby the alloy flow there through spreads lateral respect to a direction of the alloy flow there through for a resultant reduction in a velocity of the alloy flow there through relative to a velocity of the molten alloy flow through the runner such that substantially all of the alloy flowing in the die cavity is in a semi-solid state, wherein to enable production of a magnesium alloy casting substantially free of surface defects.

14. The system according to claim 13, wherein the system is operable to achieve an alloy flow velocity through the controlled expansion region which is from about 25% to 50% less than the flow velocity through the runner.

15. The system according to claim 13, wherein the system is adapted for use in pressure casting with a given machine with which the system is operable to achieve an alloy flow velocity through the runner within the range of from about 140 m/s to 165 m/s.

16. The system according to claim 14, wherein the system is adapted for use in pressure casting with a given machine with which the system is operable to achieve an alloy flow velocity through the runner within the range of from about 140 m/s to 165 m/s.

17. In a system for pressure casting magnesium alloy in a die cavity from a flow, in a flow direction defined by a runner, of the magnesium alloy in a molten state, the improvement comprising:

an expansion region for passing the flow of the magnesium alloy from the runner into a flow substantially throughout the die cavity, for spreading the flow of the magnesium alloy laterally of the flow direction and for sufficiently reducing a velocity of the flow of the magnesium alloy below a sufficient initial value to change the magnesium alloy in the expansion region from the molten state to a semi-solid state for the flow substantially throughout the die cavity.

18. The process according to claim 17, wherein the system is operable to achieve an alloy flow velocity through the controlled expansion region which is about 25% to 50% less than the flow velocity through the runner.

19. A pressure casting machine, for use in pressure casting of magnesium alloy said pressure casting machine having a supply of molten magnesium alloy and a mould or die which defines a die cavity;

wherein the machine includes a die or mould tool means which defines:

(I) a runner into which molten magnesium alloy under pressure and (ii) a controlled expansion region through which alloy received from the runner is able to pass before being injected through a gate defining an inlet to the die cavity; and wherein said pressure casting machine is of a type capable of producing a velocity of above 140 m/s in said runner and wherein the machine has a flow system which has a form providing for control of alloy flow velocities therein, said form of the flow system comprising:

(I) an effective cross-sectional area of the runner for determining the flow velocity of alloy received under pressure therein; and (ii) a form of said expansion region which enables alloy flow therein to spread laterally, with respect to its direction of injection, and thereby undergo a reduction in flow velocity in the expansion region relative to the alloy flow velocity in the runner such that said flow velocity in the runner and said reduction in flow velocity in the expansion region change the state of the alloy from a molten state in the runner into a semi-solid state for flow through the gate and into the die cavity.

20. The pressure casting machine according to claim 19 wherein the flow system includes said gate and the controlled expansion region terminates at the gate.

21. The pressure casting machine according to claim 20 wherein the gate and runner are such that an effective cross-sectional area of flow through the gate exceeds an effective cross-sectional area of flow through the runner whereby the alloy has a velocity through the effective cross-sectional area of flow through the runner which exceeds its velocity through the gate.

22. The pressure casting machine according to claim 21, wherein the cross-sectional area of flow through the gate exceeds the effective cross-sectional area of flow through the runner to an extent resulting from a ratio of those areas in the range of about 2:1 to 4:1.

23. The pressure casting machine according to claim 19, wherein the controlled expansion region is provided by a step-wise increase in cross-section from the effective cross-section of the runner whereby a step-wise said reduction in flow velocity is enabled.

24. The pressure casting machine according to claim 19, wherein the controlled expansion region progressively increases in cross-section in the direction of alloy flow there through, whereby a progressive said reduction in flow velocity is enabled.

25. The pressure casting machine according to claim 19, wherein the system is adapted for use in pressure casting with a given machine with which it is operable to achieve a velocity of alloy through the runner with the range of about 140 m/s to 165 m/s.

26. The pressure casting machine according to claim 25, wherein the system is so adapted whereby the velocity in said range is about 150 m/s.

27. The pressure casting machine according to claim 19 wherein the system is operable to achieve a flow velocity of alloy through the controlled expansion region which is about 25% to 50% less than the velocity of flow through the runner.

28. The pressure casting machine according to claim 27, wherein the system is so operable whereby the velocity through the controlled expansion region is about two-thirds of the velocity through the runner.

29. The pressure casting machine according to claim 19, wherein the runner has a designed cross-sectional area which substantially defines the effective cross-sectional area of flow there through.

30. The pressure casting machine according to claim 19, wherein said system is operable to achieve filling of the die cavity by moving semi-solid fronts of metal.

* * * * *